United States Patent [19]

Barbier

[11] 4,092,026

[45] May 30, 1978

[54] SILENT DECLARER

[76] Inventor: Robert Barbier, "Le Gallia Bella" 36 Avenue Isola Bella 06400, Cannes, France

[21] Appl. No.: 760,266

[22] Filed: Jan. 18, 1977

[30] Foreign Application Priority Data

Jan. 20, 1976 France ..... 76 01342

[51] Int. Cl.[2] ..... A63F 1/18

[52] U.S. Cl. ..... 273/148 R; 116/134

[58] Field of Search ..... 273/148 R, 148 A, 135 BC, 273/136 F; 116/134

[56] References Cited

U.S. PATENT DOCUMENTS

| | | | |
|---|---|---|---|
| 1,425,617 | 8/1922 | Terry | 273/135 BC |
| 1,656,993 | 8/1916 | Searle | 273/148 R |
| 1,772,703 | 8/1930 | Burleigh | 273/148 R UX |

*Primary Examiner*—Anton O. Oechsle

[57] ABSTRACT

The device enables a player to make silent declarations for example in the game of bridge. It comprises a case in a side of which there are series of regions having indications. Each of the indications represents a complete declaration. A withdrawable masking device is associated with each region to permit either masking the indication of the region or displaying this indication.

8 Claims, 5 Drawing Figures

SILENT DECLARER

The present invention relates to a device for effecting silent declarations in a game such as bridge or the like.

It is already known for bidding in bridge to employ a card index in which each card corresponds to a specific declaration and thus comprises a suit and the rank of the bid in this suit. An index has the following advantages:

It prevents cheating as much as it eliminates the intonation of the voice when effecting the declaration.

When the game is being played in a room containing many bridge tables, the declarations of the neighbouring tables do not interfere with those of ones own table.

When playing with more or less deaf players, it avoids repeating or raising the voice.

When playing with players speaking foreign languages, this avoids any error of comprehension of the language.

Finally, in looking at the indexes classified in the flat state on the table, in front of each player, the succession of the bidding can be immediately seen.

This known index comprises a single compartment for all the suits in which there are disposed the cardboard cards which are selectively notched so as to cause to appear in these notches the references of the cards disposed therebehind in a predetermined order. This disposition renders the extraction of the desired card delicate and complicates the putting of all of the cards back in position before starting each game.

An object of the present invention is to overcome these drawbacks while conserving the advantages of this known index.

According to the invention, there is provided a device for effecting silent declaration in a game, such as bridge, comprising a case having on one side a series of regions each of which regions has indications representing at least one part of a declaration, wherein each region comprises the indication of a complete declaration and is associated with a masking device which is selectively withdrawable to cause the chosen declaration to appear.

In the case of a device for declarations in the game of bridge, five columns are provided respectively corresponding to the five declarable suits, each suit comprising at least seven regions respectively corresponding to the seven ranks of declarations possible in each suit, each region therefore comprising the indication of a suit and a rank of a declaration.

According to one embodiment of the invention, at least an eighth region is provided comprising an indication of one of the general declarations namely "pass," "double" and "redouble."

According to another embodiment of the invention, there are provided removable plates of at least three distinct types respectively symbolising the general declarations "pass," "double" and "redouble," the plates and the masking devices comprising complementary means removably fixing the plate on said devices.

The device according to the invention permits an easy and rapid display of the chosen items of information and also a very rapid masking of all the declarations before starting a new game.

Further features and advantages of the invention will be apparent from the ensuing description with reference to the accompanying drawings which are given solely by way of example and in which.

Figure 1:
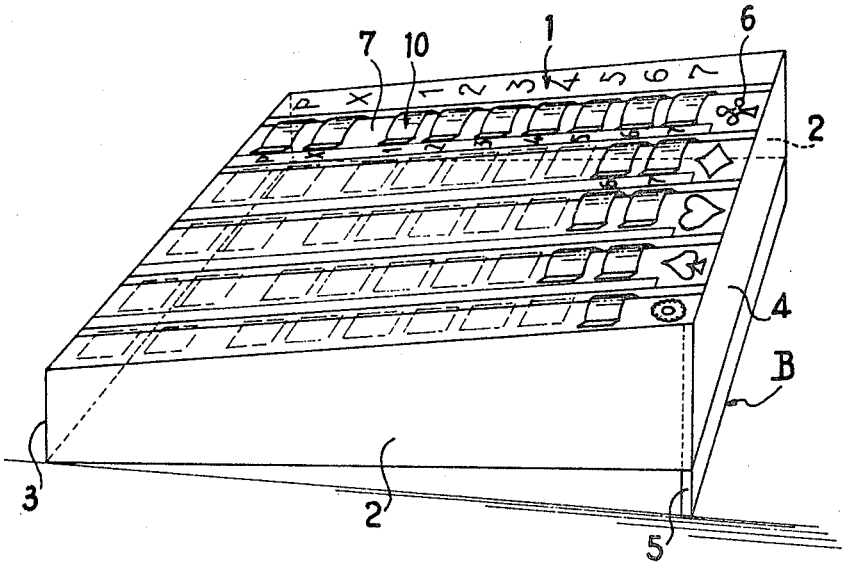
FIG. 1 is a perspective view of one embodiment of a device according to the invention for effecting declarations in the game of bridge.
Figure 2:
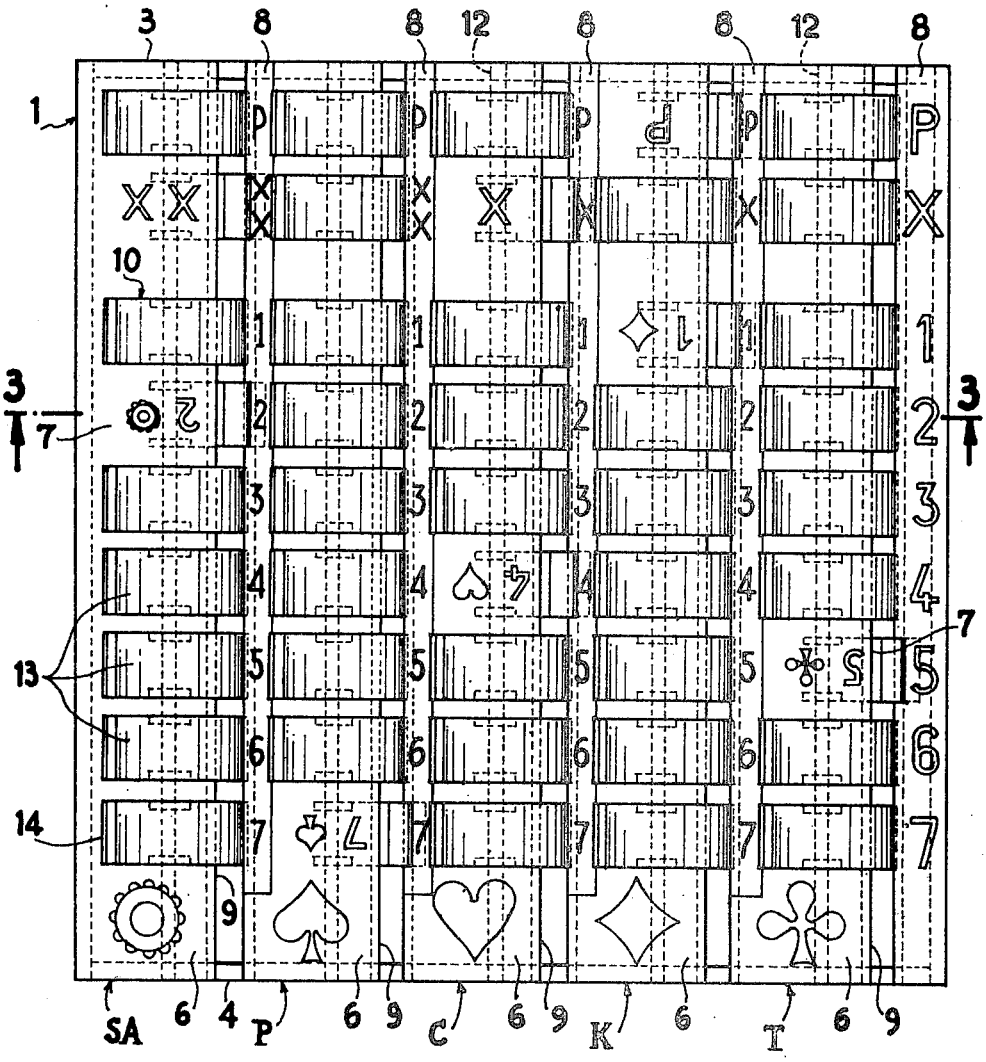
FIG. 2 is a top plan view of the table of the declarations of this device.
Figure 3:
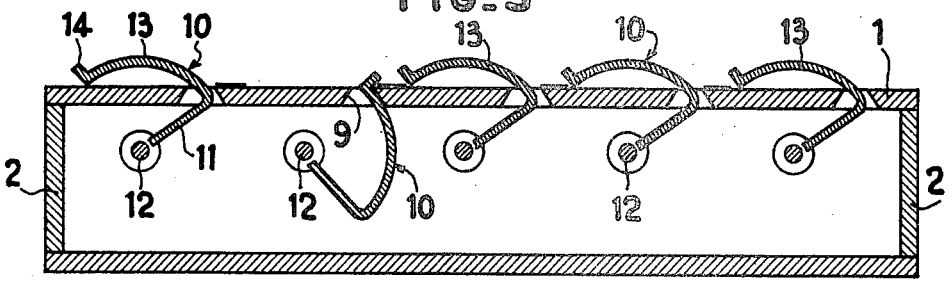
FIG. 3 is a sectional view, taken on line 3—3 of FIG. 2, showing the masking devices of the device.

According to the embodiment shown in FIGS. 1 to 3, the device comprises a case B comprising an upper rectangular side 1, two lateral sides 2 of trapezoidal shape and front and rear rectangular sides 3 and 4. The rear side 4 has a height greater than that of the rear edges of the lateral sides 2 so as to constitute an abutment or stop 5 adapted to bear against the edge of the table on which the device rests.

On the upper side 1, there are defined five columns T, K, C, P, SA, each comprising in their upper part, adjacent the rear side 4, a tablet 6 in which there is provided the symbol representing the suit pertaining to the column, namely from left to right, when viewing the rear side 4 of the device, club, diamond, heart, spade and no-trumps. Nine regions 7 are also provided in each column in which regions there are represented the indications corresponding to the different bids in the considered suit and to the "double" or "redouble" and "pass." For example, considering the column T, this comprises, in succession, in starting from the tablet 6 where there is shown the symbol designating the clubs suit, rectangular regions 7 on which there are respectively shown the indications 7 of clubs, 6 of clubs, 5 of clubs, 4 of clubs, 3 of clubs, 2 of clubs, 1 of clubs, "double", "pass." Likewise, the columns K and C of the diamond and heart suits comprise regions 7 in which there are shown the indications respectively corresponding to the same declarations in the considered suit. Finally, the two columns P and SA, respectively corresponding to the suits spades and no-trumps, each comprise a last but one region in which there are shown the indications corresponding to the "redouble" declaration instead of the "double" declaration in the other column. In each one of the regions the declaration is represented by the symbol representing the suit pertaining to the number indicating the value of the bid, whereas the "double", "redouble" and "pass" declarations are respectively symbolised by a cross, two crosses and the letter P. Moreover, these indications are provided in the direction which enables person facing the front side 3 of the case B to read them.

As at the start of a game the different regions 7 are intended to be masked by means which will be described hereinafter, there are provided in order to enable a player utilizing the device to chose selectively the region corresponding to a given declaration, strips 8 which extend alongside each of the columns T, K, C, P and SA and on which there are provided, inverted, indications shown on the regions 7 and in the region of each of these regions the signs and symbols respectively corresponding to the values of the declarations embodied by these regions. Thus, in viewing the device from the rear side 4, the strip 8 running alongside the right side of column T comprises respectively the FIGS. 7, 6, 5, 4, 3, 2, 1 and the letters X and P. Consequently, each region corresponding to a given declaration may be located by the intersection of the column of the suit with the line on which the value of the chosen declaration is shown on the corresponding strip 8.

Formed alongside the columns 8 on the upper side 1 are slots 9 which extend throughout the width of each one of the regions 7 and in each of which slots there is provided a masking or obturating device 10 which is movable between a masking position and a withdrawn position. Each masking device 10 comprises a planar rectangular portion 11 which is pivotally mounted on one of its edges on a spindle 12 and is extended on its opposite edge by a part-cylindrical sector 13 which extends through the slot 9 and is so arranged and disposed that the portion 11 extends substantially in a radial plane with respect to this sector 13. All the masking members 10 of the same column are mounted on the same spindle 12 which extends in the direction of the length of this column under the upper side 1 and is fixed at its respective ends to the front side 3 and rear side 4. The rotation of each portion 11 about this spindle 12 therefore results in a rotation of the sector 13 through the slot 9 from a position in which it completely covers its corresponding region 7 to a position in which it completely uncovers the latter and vice-versa. Provided along the free rectilinear edge of the sector 13 is a flange 14 which is adapted to retain the masking member 10 in the withdrawn position and prevent the section 13 from completely pivoting below the upper side 1 of the case, this flange enabling the user to shift the masking member 10.

The device according to the invention is employed in the following manner:

In starting, all the masking members 10 are placed in their position for masking their corresponding regions 7 and the case B is disposed with its flange 5 applied against the edge of the table, that is to say, the rear side 4 of the device faces the player who employs this device. In order to make a declaration, this player selects the masking member 10 which is disposed at the intersection of the column of the chosen suit and the line on which the value of this declaration is located in one of the strip 8 and he shifts the masking member in such manner as to uncover the corresponding region 7. If the player wishes to make one of the declarations "pass," "double" or "redouble," he selects the region of any one of the columns in which these declarations are disposed. Whatever be the chosen declaration, the latter is then clearly shown to the partners of the player owing to the inclination of the upper side 1 and to the fact that the indications appearing in the different regions are indicated in such manner as to be read the right way round by the person who is facing the player making a declaration with his device.

As bidding progresses, each player makes his declaration on the device in front of him by uncovering the corresponding region each time.

The deal having terminated, all the masking members are returned to the masking position and the device is thus ready for a new deal.

This device is therefore particularly easy to use and, as all the index cards or means are united with the case, there is no possibility of some of these cards being lost during handling, as could happen with the known index.

Figure 4:
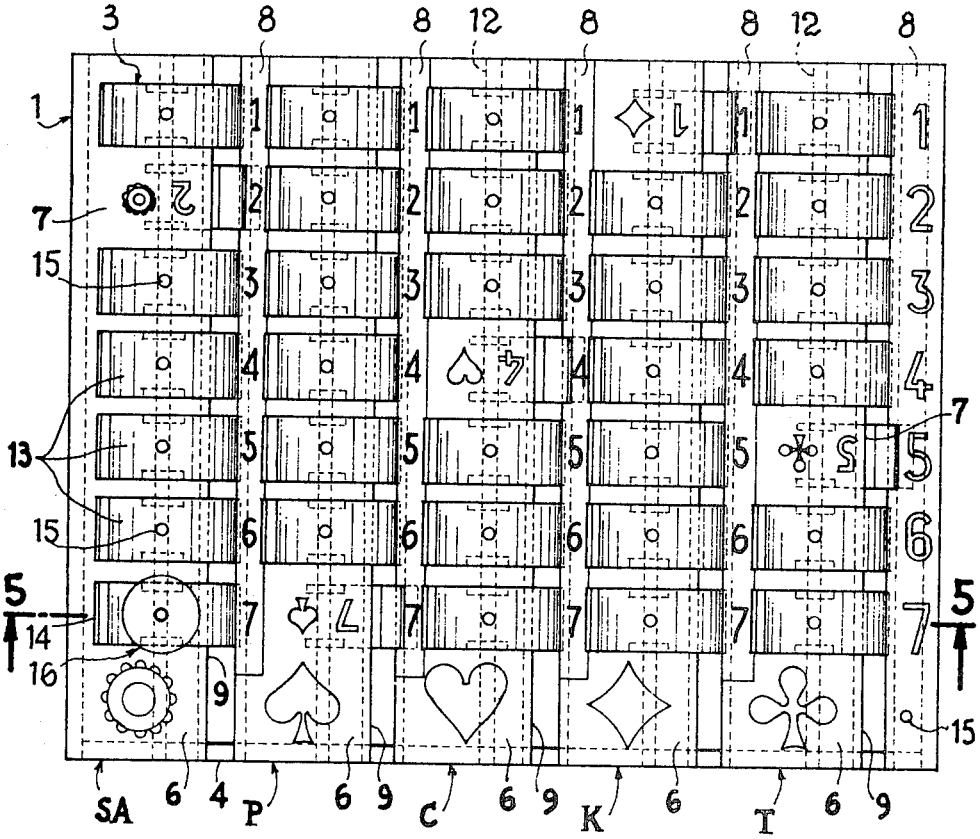
FIG. 4 is a view similar to FIG. 2 of a modification of the device according to the invention.
Figure 5:
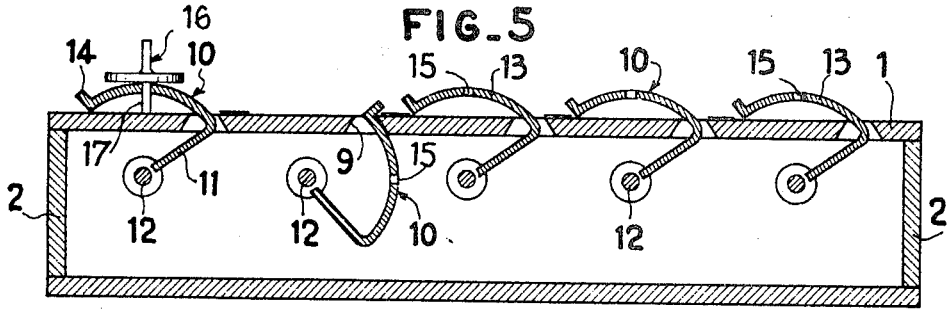
FIG. 5 is a sectional view taken on line 5—5 of FIG. 4.

With reference now to FIGS. 4 and 5, there is shown a modification of the device according to the invention which differs from the embodiments shown in FIGS. 1 to 3 in that it has only seven regions per column, the two regions corresponding to the general declarations "pass," "double" and "redouble" having been eliminated. The remainder of the device shown in FIGS. 4 and 5 is otherwise identical to that shown in FIGS. 1 to 3 apart from the fact that an aperture 15 is provided in the centre of each part-cylindrical sector 13 of a closure device 10 to enable a plate 16 to be plugged therein, this plate being provided for this purpose with a projecting pin 17. In order to make the general declarations "pass," "double" and "redouble," plates 16 are provided of three different types, for example of three different colours.

The device shown in FIGS. 4 and 5 is employed in the same way as that previously described when a player makes a declaration in one of the "clubs," "diamonds," "hearts," "spades" or "no-trumps" suits. On the other hand, in order to make one of the declarations "pass," "double" and "redouble," he selects one of the plates whose colour chosen by convention corresponds to his declaration and plugs it in the masking member which masks the region corresponding to the declaration effected by the preceding player. In order to permit each player to start with a declaration "pass," there is also provided an additional plugging region, for example in a corner of the case as shown in FIG. 4 in the lower right corner.

It will be understood that only three different plates may be provided, in which case the player who desires to repeat a declaration already made in the course of the same sequence of bidding must remove the plate from its preceding position so as to place it in the suitable new position. However, it is more judicious to provide a sufficient number of plates per player to enable the latter to avoid shifting the plates already employed in the course of the sequence of bidding so that at each instant all of the four devices respectively pertaining to the four players permit a following of the succession of declarations of the bidding sequence in course.

The embodiment shown in FIGS. 4 and 5 has over that shown in FIGS. 1 and 3, the drawback of having loose parts, but on the other hand it has the advantage of being smaller.

Advantageously, the bottom of the case may be removable or hinged (not shown in the drawings) so as to give access to the interior of the case B for placing the plates 16 therein.

Generally, any suitable material may be employed for constructing the device according to the invention. It is however advantageous to employ a plastics material both for the case and for the masking devices for reasons of economy and durability. Moreover, the indications in the different regions 7 may be printed directly or indirectly on the upper side 1 or engraved on or moulded in this upper side.

It must be understood that the invention is not intended to be limited to the described embodiments. In particular, the masking devices may be shifted or constructed in a different manner. Thus, the masking devices could be shifted electrically or mechanically. It is also possible to mount the masking devices in slots which extend along the length of the regions 7 perpendicular to the strips 8 and the spindles 12 would then extend in a direction perpendicular to the columns, between the lateral sides of the case. In the first embodiment, there could be employed movable chips which are placed or plugged in the above regions 7, or endless strips each of which is provided with an opening which allows to appear, as desired, the selected declaration. The indications of the regions 7 could also be hidden or disclosed by illuminating or extinguishing them by means of transparent windows which are illuminated from underneath by means of individual bulbs controlled by switches. Finally, in modifying the number of columns and regions per column and the indications carried by the different regions, the device may be adapted for making silent declarations in games other than bridge.

Having now described my invention what I claim as new and desire to secure by Letters Patent is:

1. A device for enabling a player to make silent declarations in the game of bridge, comprising a case having a side, five columns respectively corresponding to the five declarable suits, each column comprising at least seven regions on said side respectively corresponding to the seven possible values of declarations in each suit, indications respectively located in said regions, each indication representing a suit and a rank of a declaration in each region, and means associated with each of said regions for selectively displaying and preventing the display of the indication of each of said regions comprising movable masking means, the device further comprising plates of at least three distinct types respectively symbolizing the general declarations "pass," "double" and "redouble," the plates and the masking means comprising complementary means for removably fixing said plates to said masking means.

2. A device as claimed in claim 1, comprising symbols designating the suit of the columns, each of which symbols is located adjacent an end of the respective column, strips which extend respectively alongside the columns, signs on the strips, each sign being located adjacent a respective region and representing the rank of the declaration pertaining to said respective region.

3. A device as claimed in claim 1, wherein each column comprises at least an eighth region comprising an indication of one of the general declarations "pass," "double" and "redouble."

4. A device as claimed in claim 1, wherein said plates of three distinct types are constituted by plates of three different colours.

5. A device for enabling a player to make silent declarations in a game such as bridge, comprising a case having a side, a series of regions on said side provided with a slot, indications respectively located in said regions, each of which indications represents a complete declaration, and masking means for selectively displaying and masking the indication of each of said regions, said masking means comprising for each of said regions a masking member, a first portion and a second portion, the first portion having a first edge and a second edge opposed to said first edge, the first portion being pivotally mounted to said side along said first edge and extended by said second portion along said second edge, said second portion being a part-cylindrical sector which extends through said slot, said first portion being disposed substantially radially with respect to the part-cylindrical sector said masking member being pivotable through said slot between a masking position in which position it covers the respective region and a withdrawn position in which withdrawn position it uncovers said respective region.

6. A device as claimed in claim 5, further comprising on a free edge of each sector opposed to said second edge a flange for preventing the sector from completely pivoting through the corresponding slot.

7. A device as claimed in claim 5, wherein said masking members are disposed in a plurality of groups of aligned masking members, and there is provided for each group a spindle for pivotally mounting the members of the group, each spindle being mounted in the case.

8. A device as claimed in claim 5, further comprising plates of at least three distinct types respectively symbolizing the general declarations "pass," "double," and "redouble," each masking member defining an aperture and each of said plates having a projecting pin for plugging the plate into the aperture of one of said masking members.

* * * * *